US007602167B2

(12) United States Patent
Trafton et al.

(10) Patent No.: US 7,602,167 B2
(45) Date of Patent: Oct. 13, 2009

(54) RECONFIGURABLE TOPOLOGY FOR SWITCHING AND LINEAR VOLTAGE REGULATORS

(75) Inventors: Frederick Trafton, Lewisville, TX (US); Sujanto Gunawan, Coppell, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1017 days.

(21) Appl. No.: 10/646,854

(22) Filed: Aug. 26, 2003

(65) Prior Publication Data

US 2005/0046405 A1 Mar. 3, 2005
US 2009/0033309 A9 Feb. 5, 2009

Related U.S. Application Data

(60) Provisional application No. 60/438,164, filed on Jan. 6, 2003.

(51) Int. Cl.
*G05F 1/575* (2006.01)
*G05F 1/618* (2006.01)

(52) U.S. Cl. ..... 323/284; 323/285

(58) Field of Classification Search ..... 323/265, 323/268, 271, 273, 274, 279, 282, 284, 285, 323/351
See application file for complete search history.

(56) References Cited

U.S. PATENT DOCUMENTS 5,969,512 A * 10/1999 Matsuyama ..... 323/272
6,452,368 B1 * 9/2002 Basso et al. ..... 323/282
6,489,756 B2 * 12/2002 Kanouda et al. ..... 323/284
6,724,174 B1 * 4/2004 Esteves et al. ..... 323/224

OTHER PUBLICATIONS

ON Semiconductor CS5111 Data Sheet, Rev. 9 (Semiconductor Components Industries, LLC, Jan. 2001).
"Linear Regulators: Theory of Operation and Compensation", App. Nt. 1148 (Nat'l Semiconductor, 2000).
"Linear and Switching Voltage Regulator Fundamentals" (National Semiconductor).
"DC/DC Conversion without Inductors", APP 725 (Dallas Semiconductor, 2000).

* cited by examiner

*Primary Examiner*—Gary L Laxton
(74) *Attorney, Agent, or Firm*—Dawn V. Stephens; Wade James Brady, III; Frederick J. Telecky, Jr.

(57) ABSTRACT

A configurable voltage regulator (28; 128) operable in either of two selectable modes or topologies is disclosed. In one disclosed embodiment, the voltage regulator (28) can operate as a linear regulator or a switching regulator. A gate driver (35) and an error amplifier (36) is used in each mode. Configuration switches (34) are controlled by a configuration amplifier (40) to connect the error amplifier (36) to the gate driver (35) in the linear regulator mode, or to connect the error amplifier (36) to circuitry (42, 44, 46) for controlling the gate driver (35) in switching regulator mode. In another disclosed embodiment, the voltage regulator (128) generates a negative polarity regulated voltage according to a switching regulator or charge pump topology.

12 Claims, 5 Drawing Sheets

28

VM
$V_{CC}$
34A
50
GATE DRIVER
DRV
46
ONE SHOT
42A
35
52
$V_{CC}$-$V_T$
40
38
$V_{CC}$
44
SENS1
36C
42B
34B
SENS2
24
32
SENS3
$V_{OUT}$
BANDGAP REF
SOFT-START
36
54
56
ON-CHIP
OFF-CHIP

28

VM
$V_{CC}$
34A
60
67
GATE DRIVER
DRV
46
68
ONE SHOT
42A
35
$V_{CC}$-$V_T$
61
40
38
SENS1
44
62
36C
SENS2
42B
$V_{OUT}$
34B
64
24
32
SENS3
66
36
BANDGAP REF
SOFT-START
65
ON-CHIP
OFF-CHIP

RECONFIGURABLE TOPOLOGY FOR SWITCHING AND LINEAR VOLTAGE REGULATORS

CROSS-REFERENCE TO RELATED APPLICATIONS

This application is related to copending application Ser. No. 10/647,931, filed Aug. 26, 2003, entitled "A Reconfigurable Topology for Switching and Charge Pump Negative Polarity Voltage Regulators", now U.S. Pat. No. 6,917,240.

STATEMENT REGARDING FEDERALLY SPONSORED RESEARCH OR DEVELOPMENT

Not applicable.

BACKGROUND OF THE INVENTION

This invention is in the field of semiconductor integrated circuits, and is more specifically directed to voltage regulators implemented in a large scale integrated circuit.

Many modern electronic devices and systems, particularly those performing control and other analog functions, rely upon the generation and use of a stable regulated voltage. For example, integrated circuits for controlling motors, such as disk drive controllers in a desktop or laptop computer system or workstation, require a regulated voltage to supply the voltages required by the digital circuits operating in the disk drive. A stable regulated voltage is required to ensure that the operation of the digital circuits remains stable and consistent over varying temperature conditions, load conditions, power supply voltage levels (particularly in battery-powered systems such as laptop computers), and the like.

Several voltage regulator circuit techniques are well known in the art. A simple type of regulator is the so-called "linear" voltage regulator. As is fundamental in the art, the linear regulator includes a pass device which selectively connects an input voltage to the regulator output, at which a circuit load is connected. Control circuitry senses the output voltage, compares it to a desired regulated output voltage level, and controls the pass device according to the comparison, so that the output voltage is maintained at the desired level. Linear regulators are quite simple and inexpensive to implement using conventional integrated circuit technology.

However, linear voltage regulators are somewhat limited in their performance. Linear regulators can only regulate a voltage below the input voltage; indeed, a specified parameter of typical linear regulators is the "drop-out" voltage, which is the difference between the input voltage and the maximum output voltage that can be regulated. Even modern LDO ("low drop-out") regulators involve a drop-out voltage of on the order of a diode voltage drop.

Another type of voltage regulator is the "switching" regulator. The switching regulator involves an inductor at its output, and is based on the fundamental premise that, while the current through an inductor cannot change instantaneously, the voltage across the inductor can change instantaneously. In general, switching regulators involve a switching device, or pass device, that selectably switches the input voltage source into and out of an inductor. Typically, a pulse-width modulated signal controls the switching device, so that the output voltage is a function of the amplitude of the input voltage and the duty cycle of the switching device. Variations in the configuration of the switching regulator are possible, and achieve a great deal of design flexibility. Switching regulators of the "Buck" type regulate an output voltage that is lower than the input voltage, and switching regulators of the "Boost" type can generate an output voltage that is regulated above the voltage of the input. Other variations of switching regulators generate a regulated voltage that is of a negative polarity relative to the input voltage (e.g., in "Buck-Boost" inverting regulators), or generate multiple regulated output voltages (e.g., in "Flyback" switching regulators). Switching regulators are also often referred to as voltage "converters". In any of these forms, switching regulators typically provide higher power conversion efficiency.

However, switching regulators are typically more costly to implement than are linear regulators. The circuitry for controlling the switching operation is typically more complex than in the linear regulator, and involves additional devices and intelligence. In addition, the switching regulator involves the use of an inductor in the circuit. As well known in the art, significant inductance cannot be readily realized in a solid-state integrated circuit, thus requiring an external component to be connected to effect the switching regulator function.

The charge pump voltage regulator is also well known in the art. Typical charge pump circuits involve a capacitor that is periodically charged through a diode, again to attain a voltage that depends on the input voltage amplitude and the duty cycle of the switched charging. The diode permits the voltage at the capacitor to exceed that of the input voltage, or to be charged to a voltage that is of the opposite polarity of the input voltage. Charge pumps have been used, for example, to generate a negative substrate voltage that sets the back-gate bias of metal-oxide-semiconductor (MOS) transistors in the integrated circuit, thus controlling device performance. Charge pumps may also be used in place of switching regulators, especially in those circuits and devices in which an inductor is not available or is undesirable.

As evident from this discussion, the selection of an appropriate voltage regulator depends upon several factors including the desired output voltage, the performance of the regulator, and also whether external components such as inductors may be utilized or are desired. Because this tradeoff involves the ultimate end equipment design, the manufacturer of integrated circuits including voltage regulators may be required to produce similar integrated circuits that embody different voltage regulator schemes. In addition, it has been observed that some end equipment manufacturers may utilize the same integrated circuit in multiple implementations, in which different voltage regulator types may be useful. In this situation, the end equipment manufacturer is faced with either maintaining inventory of separate integrated circuits for the separate implementations, or with using a less-than-optimal voltage regulator in some system implementations.

It is known to construct integrated circuits that include multiple voltage regulator topologies. FIG. 1 is an example of such a conventional integrated circuit 10. In this example, integrated circuit 10 includes functional circuitry 12, which is the appropriate logic circuitry, analog circuitry, memory circuitry, or the like that carries out the overall function of integrated circuit 10. In this conventional integrated circuit 10, voltage regulators 18*a*, 18*b* are provided, where voltage regulator 18*a* is of one type and voltage regulator 18*b* is of another type. In this conventional arrangement, each of voltage regulators 18*a*, 18*b* have dedicated external terminals from integrated circuit 10, as illustrated in FIG. 1. These dedicated terminals output the regulated voltage to other integrated circuits, and are also provided so that the appropriate external components (e.g., an inductor for a switching regulator) may be connected to the corresponding voltage regulators.

Conventional dual voltage regulator integrated circuits (i.e., lacking other functional circuitry 12 as in the case of FIG. 1) are also known. An example of which is the ON SEMICONDUCTOR CS5111 device, available from Semiconductor Components Industries, LLC. The CS5111 device, for example, includes a switching regulator and a linear regulator, and serves as a regulated power supply for electronic devices and systems. In this device, the switching regulator and linear regulator are substantially separately implemented, and have separate dedicated terminals, along the lines of that shown in FIG. 1.

It has been observed, in connection with this invention, that the implementation of separate multiple voltage regulators, as carried out in conventional integrated circuits is quite inefficient. Certain elements within conventional voltage regulators can occupy significant chip area. For example, feedback capacitors for error amplifiers within the sense and control loop of conventional voltage regulators can be quite large. The implementation of two separate voltage regulators according to conventional techniques is therefore costly in terms of chip area. In integrated circuits having significant functional circuitry, a large number of terminals (inputs, outputs, and common input/output terminals) are often required. In these large scale integrated circuits, the provision of each external terminal can be quite costly, not only in package size and complexity, but also in the chip area required to safely route signals to the external terminal. It is therefore desirable to minimize the number of external terminals for large scale integrated circuits.

BRIEF SUMMARY OF THE INVENTION

It is therefore an object of this invention to provide an integrated circuit that efficiently includes multiple voltage regulators of different types.

It is a further object of this invention to provide such an integrated circuit in which large components are shared among voltage regulators of the different types.

It is a further object of this invention to provide such an integrated circuit in which external terminals are shared among voltage regulators of the different types.

It is a further object of this invention to provide such an integrated circuit in which the selection of one of the multiple voltage regulators can be made by way of external components.

It is a further object of this invention to provide such an integrated circuit in which the selection of one of the multiple voltage regulators can be made by way of a configuration register.

Other objects and advantages of this invention will be apparent to those of ordinary skill in the art having reference to the following specification together with its drawings.

The present invention may be implemented into an integrated circuit having a configurable voltage regulator that is capable of operating according to one of multiple types. The voltage regulator uses one or more common external terminals in operating according to either type of regulator, and uses at least one significant internal component, such as an error amplifier and feedback capacitor, or gate driver, in each of the two modes.

In one aspect of the invention, the voltage regulator is configurable as to operate as either a switching regulator or a linear regulator. The voltage regulator is configured by biasing an external terminal that is shared in each mode. In this example, the same gate driver and error amplifier is used in each of the switching and linear regulator configurations, as is the external terminal from which the switching or pass device is driven.

DETAILED DESCRIPTION OF THE INVENTION

The present invention will be described in connection with its preferred embodiment, namely as an integrated circuit having additional functional circuitry, such as a spindle motor controller as used in connection with a computer disk drive, because this invention is contemplated to be especially useful in such an application. However, it will be understood by those skilled in the art having reference to this specification that this invention will also be beneficial in other applications, including integrated circuits of different ultimate functions, and also as a stand-alone voltage regulator device. Accordingly, it is to be understood that the following description is provided by way of example only, and is not intended to limit the true scope of this invention as claimed.

Figure 1:
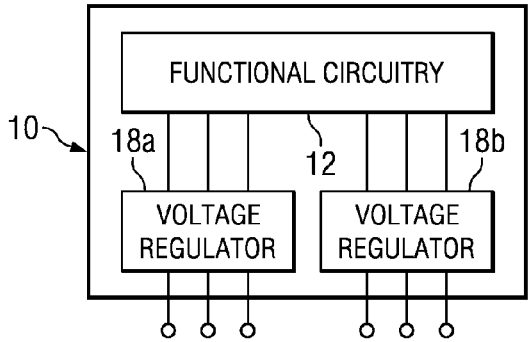
FIG. 1 (PRIOR ART)
FIG. 1 is an electrical diagram, in block form, of a conventional integrated circuit including multiple voltage regulators.
Figure 2:
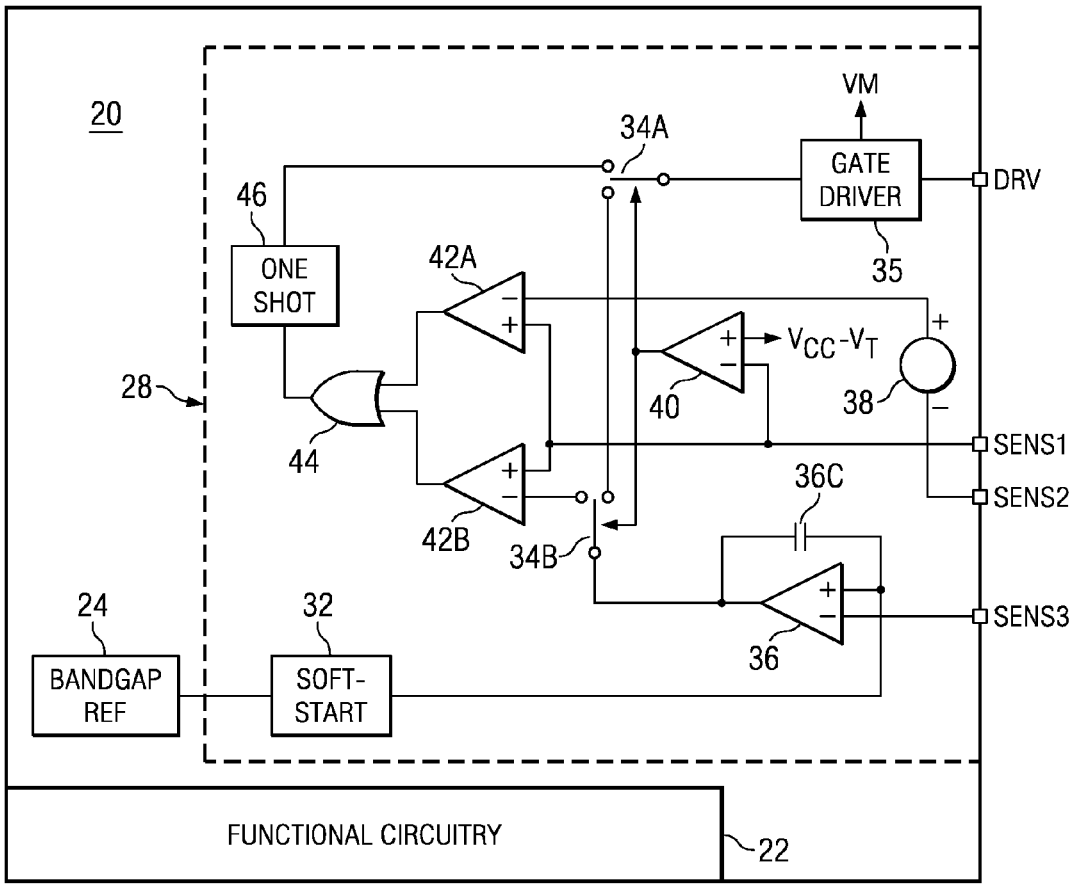
FIG. 2 is an electrical diagram, in schematic and block form, of an integrated circuit constructed according to the preferred embodiment of the invention.

Referring first to FIG. 2, integrated circuit 20 according to the preferred embodiment of the invention will now be described. Integrated circuit 20, in this example, includes functional circuitry 22 for performing a particular device function, and also includes voltage regulator 28 constructed according to the preferred embodiment of the invention. Functional circuitry 22 is logic or other circuitry for performing a desired electronic function, and will be connected to various input, output, and input/output terminals (not shown) of integrated circuit 20 in order to effect that function. Of course, functional circuitry 22 may include such circuitry as used to perform any function suitable for realization in an integrated circuit, and as such the various circuitry implemented within functional circuitry 22 may vary widely. Further in the alternative, functional circuitry 22 may be omitted from integrated circuit 20, for example where the entire function of integrated circuit 20 is a voltage regulator or voltage converter, for example if the function of integrated circuit 20 is to control the power supply of a computer disk drive. It is contemplated that those skilled in the art having reference to this specification will be readily able to implement this invention within an integrated circuit of any function desired.

According to the preferred embodiment of the invention shown in FIG. 2, voltage regulator 28 in integrated circuit 20 is connected to several external terminals DRV, SENS1, SENS2, SENS3. As will become apparent from the following description, voltage regulator 28 drives an external pass or switching transistor from terminal DRV, while terminals SENS1, SENS2, SENS3 provide feedback to voltage regulator 28, and also configure its mode of operation, which in this embodiment of the invention, can be either as a linear regulator or a switching regulator. Alternatively, voltage regulator 28 may be configured by writing to a register, or by way of logic circuitry responsive to program or user control, or further in the alternative may operate according to different voltage regulator topologies.

In this preferred embodiment of the invention, voltage regulator 28 includes error amplifier 36, which is used in each of the two operating configurations. Error amplifier 36 is a conventional differential amplifier, biased in the conventional manner (not shown), including feedback capacitor 36C connected between its output and its non-inverting input. The non-inverting input of error amplifier 36 also receives a reference voltage generated by bandgap reference circuit 24, which is a conventional circuit for generating a reference voltage that is stable over temperature and power supply voltage variations, as known in the art. Bandgap reference circuit 24 is illustrated as implemented outside of voltage regulator 28, in this embodiment of the invention, considering that its output reference voltage may also be used elsewhere within integrated circuit 20. The reference voltage from bandgap reference circuit 24 is preferably coupled to error amplifier via soft-start circuit 32 in voltage regulator 28. Soft-start circuit 32 is a conventional circuit for ramping the application of the reference voltage from bandgap reference circuit 24 to error amplifier 36, such as during startup or reset of integrated circuit 20, so that the output regulated voltage also ramps up during that time, to avoid output current spikes.

Error amplifier 36 has an output that is connected to the pole of switch 34B. Switch 34B has two throws, one connected to an inverting input to differential amplifier 42B, and the other connected to one of the throws of switch 34A. The pole of switch 34A is connected to gate driver 35, which drives terminal DRV at the output of voltage regulator 28, from a bias voltage VM. The other throw of switch 34A is driven by the output of one shot multivibrator 46, and as such switch 34A selects the circuit element within voltage regulator 28 that drives gate driver 35. Switches 34A, 34B are controlled by the output of configuration amplifier 40, which is a differential amplifier having a fixed voltage at its non-inverting input, and terminal SENS1 at its inverting input. The fixed voltage applied to the non-inverting input, according to this embodiment of the invention, is power supply voltage $V_{cc}$ less a diode drop ($V_t$), as shown in FIG. 2. Configuration amplifier 40 controls the state of switches 34A, 34B in response to the comparison between the voltage at terminal SENS1 and the fixed voltage (e.g., power supply voltage $V_{cc}$ less $V_t$), and thus sets the operating mode of voltage regulator 28, as will be described in further detail below.

Switches 34A, 34B are preferably implemented as pass transistors, implemented in the particular technology (bipolar, MOS, BiCMOS, or the like) according to which the remainder of integrated circuit 20 is constructed. For example, each of switches 34A, 34B may be easily implemented in the form of complementary MOS pass transistors, in the case where functional circuitry 22 is constructed according to CMOS technology. It is contemplated that those skilled in the art having reference to this specification will be readily able to implement configuration switches 34A, 34B in an efficient manner for the particular technology involved in the remainder of integrated circuit 20.

In addition, while a pair of configuration switches 34A, 34B are illustrated in this embodiment of the invention, it is of course contemplated that a different number of configuration switches may be used, depending upon the particular arrangement of the elements of voltage regulator 28. For example, it is contemplated that a single configuration switch may be useful in some realizations, while three or more switches may be used in other realizations.

As mentioned above, the inverting input of differential amplifier 42B is connected to a throw of switch 34B; the non-inverting input of differential amplifier 42B is connected to terminal SENS2, as is the non-inverting input of differential amplifier 42A. The inverting input of differential amplifier 42A is coupled to terminal SENS2 through voltage source 38. The outputs of amplifiers 42A, 42B are connected to inputs of logic function 44, which has its output connected to one-shot multivibrator 46. In this preferred embodiment of the invention, one-shot multivibrator 46 is a constant off-time one-shot, generating a high logic level output except when triggered by a pulse at its input. As known in the art, the constant off-time one-shot multivibrator maintains its output low for a specified time after the end of the triggering pulse at its input. Accordingly, logic function 44 in this example is an OR gate. As mentioned above, the output of constant off-time one-shot multivibrator 46 is selectably coupled to the control input of gate driver 35 through switch 34A.

Figure 3A:
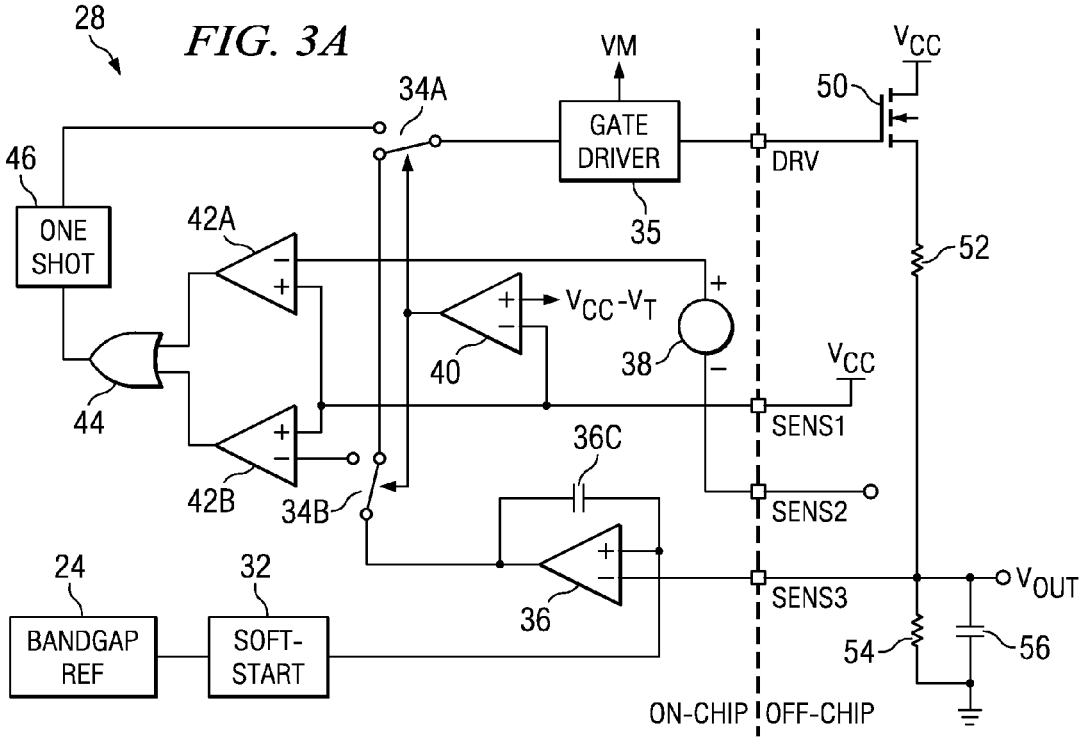
FIG. 3*a* is an electrical diagram, in schematic and block form, of the voltage regulator circuitry in the integrated circuit of FIG. 2, according to the preferred embodiment of the invention, illustrating its configuration as a linear regulator.
Figure 3B:
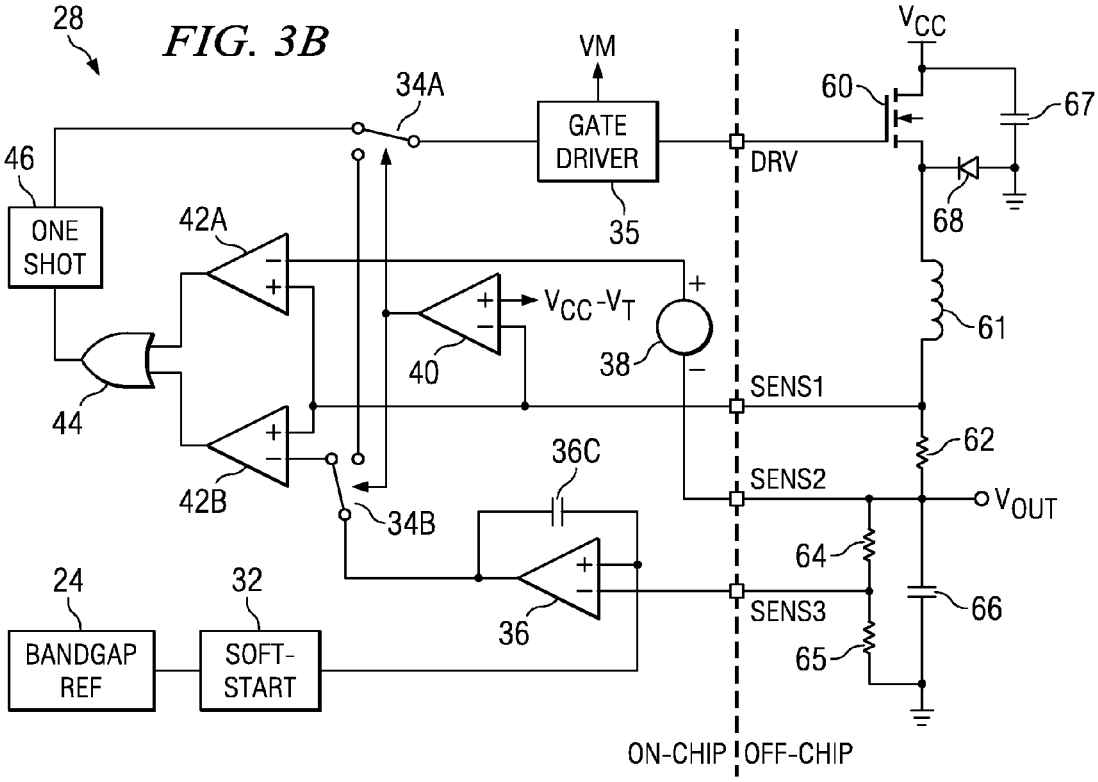
FIG. 3*b* is an electrical diagram, in schematic and block form, of the voltage regulator circuitry in the integrated circuit of FIG. 2, according to the preferred embodiment of the invention, illustrating its configuration as a switching regulator.

In operation, according to this preferred embodiment of the invention, voltage regulator 28 is configured by the voltage at external terminal SENS1, and specifically according to whether the voltage at external terminal SENS1 exceeds or falls below the fixed voltage at the non-inverting input of configuration amplifier 40. In addition, the system implementer will connect the appropriate external components to terminals DRV, SENS1, SENS2, SENS3 for the selected voltage regulator configuration. FIGS. 3*a* and 3*b* illustrate the configuration of voltage regulator 28 as linear and switching regulators, respectively, as will now be described.

Referring now to FIG. 3*a*, voltage regulator 28 is shown in its linear regulator configuration. As mentioned above, the fixed voltage applied to the non-inverting input of configuration amplifier 40 is at least a diode voltage drop ($V_t$) below power supply voltage $V_{cc}$. Accordingly, in this embodiment of the invention, the linear amplifier mode is selected by the biasing of external terminal SENS1 to power supply voltage $V_{cc}$, as shown in FIG. 3. This biasing causes configuration amplifier 40 to control switches 34A, 34B to connect the output of error amplifier 36 to the input of gate driver 35, as shown in the example of FIG. 3*a*. This configures voltage regulator 28 as a linear regulator.

The external components to voltage regulator 28 in its linear regulator configuration include n-channel MOS pass transistor 50, which has its drain connected to power supply voltage $V_{cc}$ (or to a higher power supply voltage than power supply voltage $V_{cc}$, if desired). Pass transistor 50 has its gate driven from terminal DRV at the output of gate driver 35. The source of pass transistor 50 is connected to one end of a series path through resistors 52, 54 to ground. Output terminal $V_{out}$ is at the voltage divider node between resistors 52, 54, and output capacitor 56 is connected between output terminal $V_{out}$ and ground. It is contemplated that those skilled in the art having reference to this specification will be able to readily select the parameters and values of each of these external devices, including pass transistor 50, resistors 53, 54, and capacitor 56. External terminal SENS3 of voltage regulator 28 (and integrated circuit 20) is connected to output terminal $V_{out}$. External terminal SENS2 of voltage regulator 28 is not used in this configuration, and is simply left open.

In operation as a linear regulator, the voltage at output terminal $V_{out}$ and at external terminal SENS3 is applied to the inverting input of error amplifier 36, which compares this voltage to the bandgap reference voltage at the non-inverting input of error amplifier 36. In this configuration, switches 34A, 34B directly connect the output of error amplifier 36 to gate driver 35. If the voltage at output terminal $V_{out}$ is below the bandgap reference voltage, error amplifier 36 issues a positive polarity voltage at its output, which causes gate driver 35 to turn on external pass transistor 50. With pass transistor 50 on, output terminal $V_{out}$ is charged from power supply voltage $V_{cc}$. Upon the voltage at output terminal $V_{out}$ exceeding the bandgap reference voltage, error amplifier 36 then issues a negative polarity output to gate driver 35, causing it to turn off external pass transistor 50. Upon the voltage at output terminal $V_{out}$ then falling below that of the band gap reference voltage, error amplifier 36 causes gate driver 35 to again turn on pass transistor 50, and the process repeats. In this manner, voltage regulator 28 operates as a feedback control linear voltage regulator, driving output terminal $V_{out}$ to a voltage matching its reference voltage (e.g., the bandgap reference voltage produced by bandgap reference circuit 24).

Referring now to FIG. 3*b*, the configuration and operation of voltage regulator 28 as a switching regulator of the constant off-time "Buck" mode type, will now be described. As known in the art, various configurations of switching regulators may be used, depending on the voltage required, and also the desired manner of regulation. Conventional classes of switching regulators include "Buck" regulators of various types, "Boost" regulators, "Boost-Buck" regulators, and "flyback" switching regulators, for example. Accordingly, the configuration of voltage regulator 28 as illustrated in FIG. 3*b* is provided by way of example only, and is not intended to limit the scope of the invention as claimed.

In this example, external n-channel MOS switching transistor 60 has its gate connected to terminal DRV, which is driven by gate driver 35 of voltage regulator 28 as described above. The drain of switching transistor 60 is biased to power supply voltage $V_{cc}$, and its source is connected to one end of external inductor 61. A network of capacitor 67 and diode 68 is connected in parallel with the drain-to-source path of switching transistor 60, with the anode of diode 68 at its connection to capacitor 67 tied to ground.

Inductor 61 is connected in series between the source of switching transistor 60 and resistor 62. The node at the connection between inductor 61 and resistor 62 is connected also to terminal SENS1 of integrated circuit 20, which is connected to the inverting input of configuration amplifier 40 and the non-inverting inputs of differential amplifiers 42A, 42B. Resistor 62 is in an R-C network that defines the voltage at output terminal $V_{out}$, at a node between resistor 62 and one plate of output capacitor 66, which has its other plate at ground; this node is also connected to terminal SENS2, and thus to the inverting input of differential amplifier 42A via voltage source 38. Resistor 64 is in series with resistor 65 in a path between output terminal $V_{out}$ and ground. The voltage divider node between resistors 64 and 65 is connected to terminal SENS3, and thus to the inverting input of error amplifier 36 in voltage regulator 28.

The configuration of voltage regulator 28 as a switching regulator is effected by terminal SENS1 being below the fixed voltage applied to the non-inverting input of configuration amplifier 40. In the preferred embodiment of the invention, the fixed voltage is set at a diode drop, or threshold voltage, below power supply voltage $V_{cc}$ (i.e., $V_{cc}$-$V_t$). In the configuration of FIG. 3*a*, terminal SENS1 will necessarily be no higher than this fixed voltage, because switching transistor 60 is n-channel, and assuming that the output of gate driver 35 will not exceed power supply voltage $V_{cc}$ (because its bias voltage VM is below $V_{cc}$). This bias ensures that the source of transistor 60 cannot rise above a threshold voltage lower than its drain voltage, which is at power supply voltage $V_{cc}$. Accordingly, the output of configuration amplifier 40 causes switch 34A to connect gate driver 35 to the output of constant off-time one-shot multivibrator 46, and causes switch 34B to connect the output of error amplifier 36 to the inverting input of differential amplifier 42B.

Differential amplifiers 42A, 42B are thus enabled to respond to the voltages at terminals SENS2, SENS3, respectively. The voltage at terminal SENS2 is increased by voltage source 38, for example increased by a small amount such as 0.3 volts, and the increased voltage is applied to the inverting input of differential amplifier 42A for comparison against the voltage at terminal SENS1. Accordingly, differential amplifier 42A determines whether the voltage drop across resistor 62 exceeds the voltage of voltage source 38, which in effect determines whether the load current through inductor 61 exceeds a predetermined threshold defined by the resistance of resistor 62 and the voltage of voltage source 38. As such, differential amplifier 42A operates as a current limiter. On the other hand, error amplifier 36 outputs a voltage corresponding to the difference between the voltage at terminal SENS3, at the node between resistors 64, 65, and the bandgap reference voltage. The error voltage output from error amplifier 36 is thus an indication of the output voltage at output terminal $V_{out}$. Differential amplifier 42B effectively compares the error voltage output against the voltage at terminal SENS1, and provides this result to logic function 44, which in turn controls constant off-time one-shot multivibrator 46. As such, differential amplifier 42B effectively controls the output voltage at output terminal $V_{out}$, as will now be described.

In operation, voltage regulator 28 begins charging output terminal $V_{out}$ from a low voltage near ground. Initially, the voltage at terminal SENS3 is below the bandgap reference voltage (as presented by soft-start circuit 32). The relatively large positive polarity error voltage from error amplifier 36 results in differential amplifier 42B presenting a low voltage to OR function 44. This low level input to OR function 44, along with the initial low output of differential amplifier 42A from the initial low output current, applies a low level input to constant off-time one-shot 46, maintaining the output of constant off-time one-shot 46 at a high level, which is passed through configuration switch 34A to gate driver 35. Gate driver 35 thus drives transistor 60 to an on-state, passing current through inductor 61 to charge capacitor 66, and raising the voltage at output terminal $V_{out}$. In this embodiment of the invention, prior to the voltage at output terminal $V_{out}$ reaching its regulated voltage, the charging current conducted through transistor 60 and inductor 61 typically increases enough that the voltage drip across resistor 62 exceeds that of voltage source 38; in this event, the state of differential amplifier 42A will switch, presenting a high logic level to OR function 44, and presenting a high logic level pulse to constant off-time one-shot 46. This causes constant off-time one-shot 46 to de-energize its output, which turns off gate driver 35 and transistor 60. The current conducted by inductor 61 will continue at least instantaneously (via diode 68), then decaying so that the voltage drop across resistor 62 drops below the voltage of voltage source 38, at which time the output of differential amplifier 42A goes low, ceasing the high level pulse at the output OR gate 44 that is presented to constant off-time one-shot 46. Upon the output of OR gate 44 going low again, but after the constant off-time period elapses, constant off-time one-shot 46 then again energizes its output to turn on gate driver 35, which in turn turns on transistor 60, until the voltage drop across resistor 62 again exceeds that of voltage source 38. This sawtooth operation continues until the voltage at output terminal $V_{out}$ approaches the desired regulated voltage, at which point the current conducted through inductor 61 and resistor 62 remains relatively small, at which time the voltage drop across resistor 62 remains small and no longer controls the operation of voltage regulator 28, absent any large event (e.g., a change in the load, a reset event, or the like).

The voltage at output terminal $V_{out}$ determines the voltage at terminal SENS3, which is measured against the bandgap reference voltage by error amplifier 36 and, once sufficiently charged, controls the operation of voltage regulator 28, as will now be described. When the voltage at terminal SENS3 exceeds the bandgap reference voltage, error amplifier 36 produces a negative voltage that, in turn, causes error amplifier 42B to issue a positive polarity level to OR function 44. OR function 44 in turn presents a high level at the input to constant off-time one-shot 46, which turns off the output of constant off-time one-shot 46 and thus turns off gate driver 35 and transistor 60. The current through inductor 61 remains instantaneously constant through the operation of diode 68, after transistor 60 turns off, and the voltage at output terminal $V_{out}$ instantaneously remains at its same level. Eventually, however, the voltage at output terminal $V_{out}$ and thus at terminal SENS3 begins to decay, as does the current through inductor 61. Upon the sensed voltage at terminal SENS3 falling below the bandgap reference voltage, error amplifier 36 produces a negative polarity output, causing differential amplifier 42B to generate a negative output, which causes OR gate 44 to present a low level input at the input to constant off-time one-shot 46. After the constant off-time elapses, constant off-time one-shot 46 then again turns on gate driver 35, turning on transistor 60, which pulls up output terminal $V_{out}$, again until the voltage at terminal SENS3 reaches the bandgap reference voltage as measured at error amplifier 36, at which time the process repeats. Voltage regulator 28 continues to operate in this manner, thus presenting a stable regulated voltage at output terminal $V_{out}$.

Voltage regulator 28 is thus able to operate either as a switching regulator, as shown in the configuration of FIG. 3*b*, or as a linear regulator, as shown in the configuration of FIG. 3*a*. According to this embodiment of the invention, therefore, the same integrated circuit may include voltage regulators of different topologies, with the selection of the regulator topology readily made by the manner in which the integrated circuit is implemented into its system or end equipment. The system integrator using the integrated circuit according to this embodiment of the invention is therefore able to utilize the same integrated circuit in different implementations, without requiring separate manufacturing inventory of the integrated circuits itself. This important ability is attained, according to this invention, in a manner that is especially efficient, considering that the different voltage regulator topologies are able to share significant portions of the voltage regulator circuitry, especially large devices in terms of chip area such as the error amplifier and the feedback capacitor for the error amplifier. In addition, external terminals and internal conductors to those terminals are also shared by the available voltage regulator topologies, implementing still further efficiency in the resulting device, especially in very large scale integrated circuits that have many terminals, and for which additional external terminals are quite costly.

As mentioned above, the foregoing example illustrates a voltage regulator that can be configured as either a linear regulator or a Buck type switching regulator. According to this invention, other types of regulators may similarly be implemented within the same integrated circuit, also sharing external terminals and some of the internal circuitry. The types of regulators implemented will typically depend upon the polarity and amplitude of the voltage being regulated, relative to the power supply voltage applied to the device.

Figure 4:
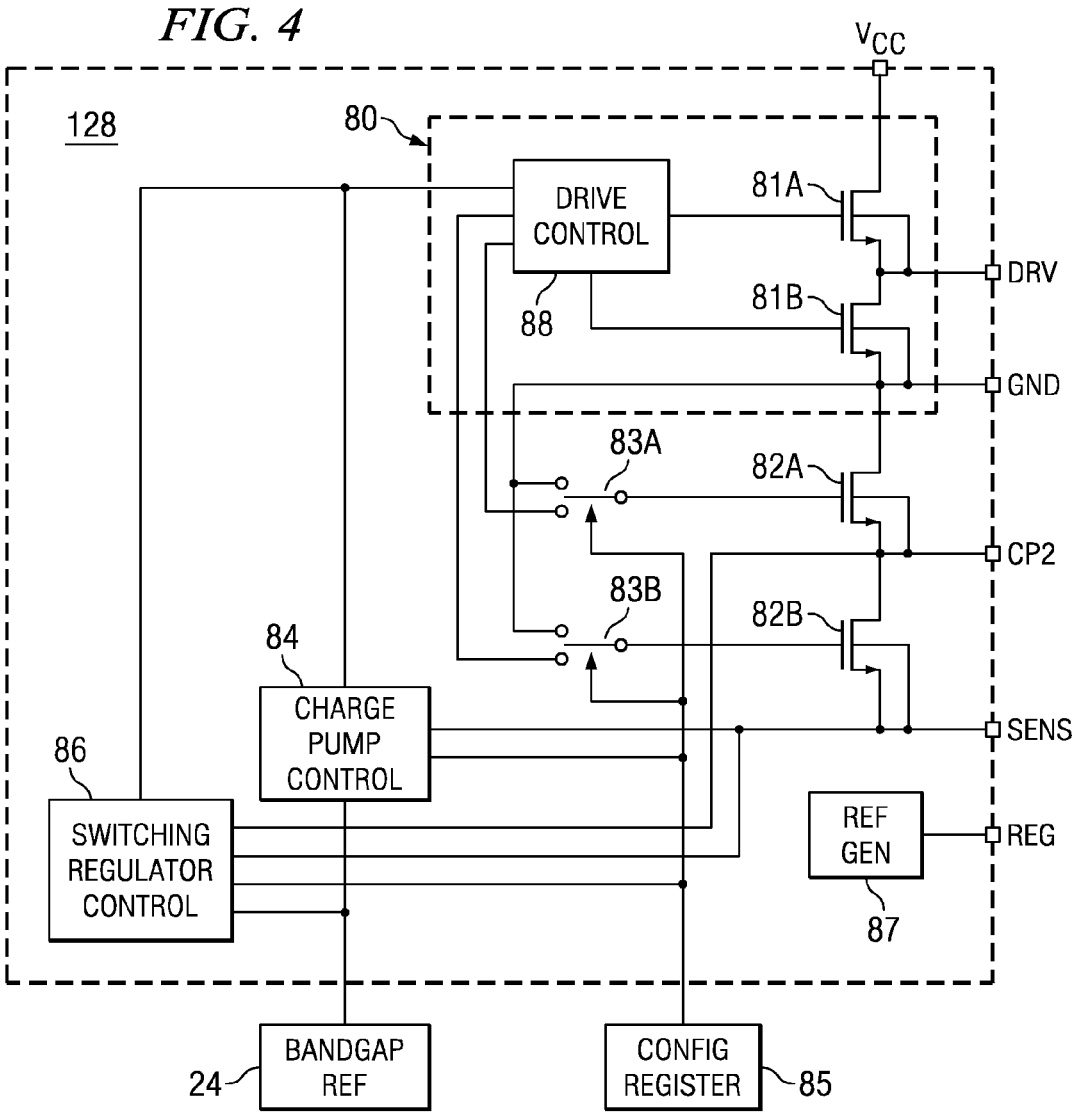
FIG. 4 is an electrical diagram, in schematic and block form, of voltage regulator circuitry in the integrated circuit of FIG. 2 according to an alternative preferred embodiment of the invention.

An example of a voltage regulator that is configurable as a charge pump voltage regulator or a negative polarity switching regulator is described in detail in copending application Ser. No. 10/647,931, filed Aug. 26, 2003, entitled "A Reconfigurable Topology for Switching and Charge Pump Negative Polarity Voltage Regulators", now U.S. Pat. No. 6,917,240. FIG. 4 illustrates a configurable voltage regulator according to this preferred embodiment of the invention.

Reconfigurable voltage regulator 128 is connected to external terminals of the integrated circuit, in similar manner as described above. In this example, external power supply terminal VCC receives the power supply voltage $V_{cc}$, in the conventional manner, and is connected to the drain of shared n-channel MOS transistor 81A in output driver 80. As will be described in detail below, output driver 80 is used in each of the charge pump and switching regulator modes. The source of MOS transistor 81A is connected to the drain of shared n-channel MOS transistor 81B. The gates of shared MOS transistors 81A, 81B are controlled by drive control circuit 83, and the body node of each of shared MOS transistors 81A, 81B are connected to their respective sources. Terminal DRV is connected to the node at the source of transistor 81A and the drain of transistor 81B, and terminal GND is connected to the source of transistor 81B. In typical configurations, terminal GND will be externally connected to ground potential.

N-channel MOS transistor 82A has its drain connected to the source of shared transistor 81B, at terminal GND, and has its source connected to terminal CP2. In turn, n-channel MOS transistor 82B has its drain connected to the source of transistor 82A, and its source connected to terminal SENS. The gates of MOS transistors 82A, 82B are connected to the pole of configuration switches 83A, 83B, respectively. As mentioned above, configuration switches 83A, 83B may be implemented in an appropriate manner for the particular technology of the integrated circuit; for example, CMOS pass transistors may be used to realize configuration switches 83A, 83B, in the case where the remainder of the integrated circuit is fabricated according to CMOS or BiCMOS technology. Each of configuration switches 83A, 83B are controlled, in this embodiment of the invention, by one or more bits in configuration register 85, which is writable under user or program control by other circuitry (not shown) in the integrated circuit. One throw of each of configuration switches 83A, 83B is connected to terminal GND. In switching regulator mode, configuration register 85 controls configuration switches 83A, 83B to connect the gates of transistors 82A, 82B to terminal GND, disabling these devices in that mode.

Conversely, configuration switches 83A, 83B operate to connect the gates of transistors 82A, 82B to drive control circuitry 88 in output driver 80 when voltage regulator 128 is in charge pump mode. Charge pump control circuitry 84 receives feedback inputs from respective throws of configuration switches 83A, 83B and from terminal SENS, and also receives a bandgap reference voltage from bandgap reference circuit 24. Charge pump control circuitry 84 issues a control signal, when enabled by configuration register 85, to drive control circuit 88 in output driver 80. Conversely, switching regulator control circuit 86 receives feedback inputs from terminals CP2 and SENS, and receives the bandgap reference voltage from bandgap reference circuit 24. When enabled by configuration register 85, switching regulator control circuit 86 issues control signals to drive control circuit 88 in output driver 80. Voltage regulator 128 also includes reference voltage generator circuit 87, which is connected to terminal REG, for use in switching regulator mode.

In operation, the selection of the operating mode of voltage regulator 128 is effected by the external connection of the appropriate devices to terminals DRV, CP2, SENS, and REG. In either mode, terminal VCC receives power supply voltage $V_{cc}$, and terminal GND is connected to system ground. Configuration register 85 is then written with the appropriate register word or bits that select the corresponding regulator mode. The writing of configuration register 85 may be carried out by the integrated circuit itself, for example under program control. Alternatively, configuration register 85 may be externally accessible, for example by way of a serial data terminal, to enable writing of configuration register 85 by the device user or the system within which voltage regulator 128 is implemented. Further in the alternative, in place of configuration register 85, logic circuitry may be provided that responds to a bias condition on a configuration terminal, such as described above relative to FIGS. 2, 3*a* and 3*b*.

Figure 5A:
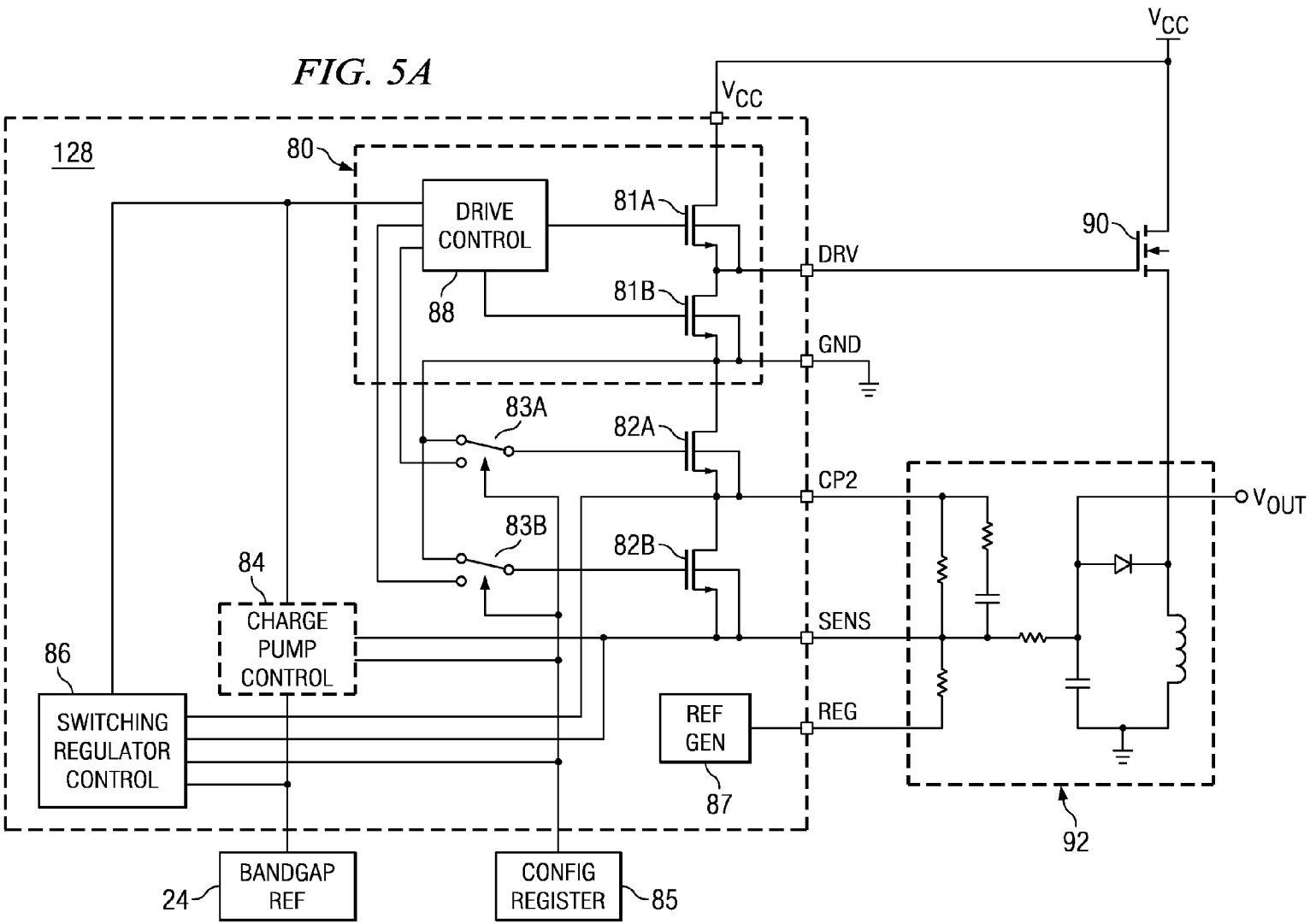
FIG. 5*a* is an electrical diagram, in schematic and block form, of the voltage regulator of FIG. 4, illustrating its configuration as a switching regulator.

FIG. 5*a* illustrates an example of voltage regulator 128 as configured as a negative switching regulator. Switching p-channel MOS transistor 90 has its source biased to power supply voltage $V_{cc}$, and its gate connected to terminal DRV. The drain of transistor 90 is connected to passive network 92, which includes the appropriate network of an inductor, diode, and output capacitor, and resistor network, by way of which the output voltage at output terminal $V_{out}$ is derived. A reference voltage generated by reference generator 87 is applied to the passive network from terminal REG, as shown. Feedback voltages at terminals CP2 and SENS are applied to switching regulator control 86, which in turn controls drive control circuit 88 and thus the current driven by switching transistor 90.

It is contemplated that those skilled in the art having reference to this specification will be readily able to construct the appropriate logic and circuitry involved in switching regulator control circuit 86. According to this preferred embodiment of the invention, switching regulator control circuit 86 includes an error amplifier that compares the voltage at terminal SENS against the bandgap reference voltage from bandgap voltage regulator circuit 24, and compares the error voltage against a triangle waveform at a configurable frequency, establishing a pulse width modulated control signal to output driver 80. In this example, output driver 80 operates as a non-inverting buffer, so that the control signal effectively drives transistor 60 in a pulse-width modulated fashion. Additional circuitry may also be included within switching regulator control circuit 86, including a negative fault indicator that indicates when the regulator is not in regulation.

Additional detail regarding the construction and operation of switching regulator control circuit 86 is provided in the above-incorporated copending application Ser. No. 10/647,931, entitled "A Reconfigurable Topology for Switching and Charge Pump Negative Polarity Voltage Regulators".

Portions of the circuitry used in the charge pump regulator mode are disabled when voltage regulator 128 is configured as a switching regulator. In this example, configuration register 85 controls configuration switches 83A, 83B to connect the gates of transistors 82A, 82B, respectively, to ground potential at terminal GND, disabling those devices. Charge pump control circuitry 84 is also disabled by configuration register 85 in this mode, and conversely switching regulator control circuit 86 is enabled by configuration register 85.

Figure 5B:
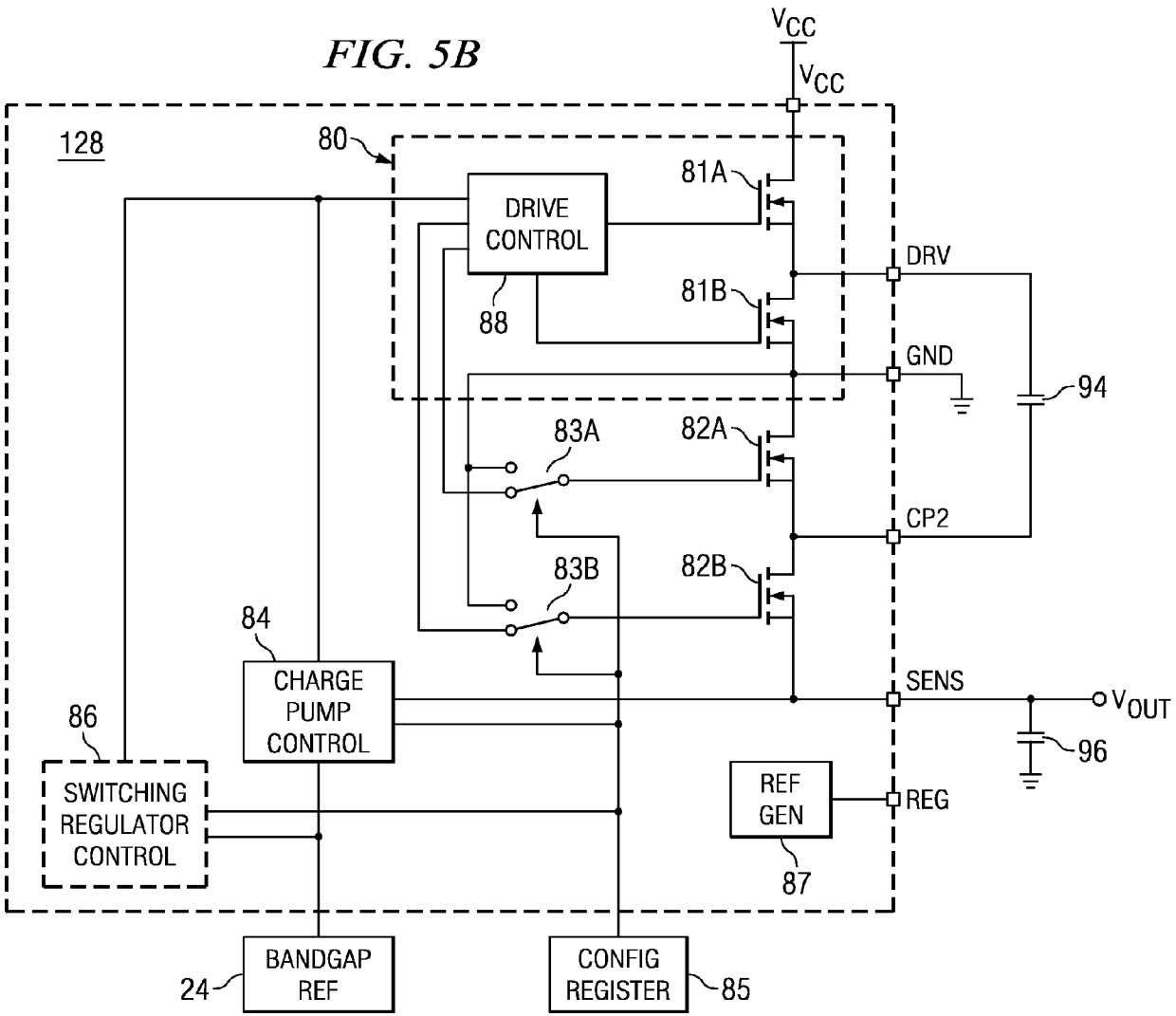
FIG. 5*b* is an electrical diagram, in schematic and block form, of the voltage regulator of FIG. 4, illustrating its configuration as a charge pump regulator.

Referring now to FIG. 5*b*, the configuration of voltage regulator 128 as a charge pump regulator, according to this embodiment of the invention, will now be described. The external components include simply capacitor 94, which is a flyback capacitor connected across terminals DRV and CP2, and output capacitor 96, which is connected between terminal SENS, at which output terminal $V_{out}$ is driven, and system ground. Terminal GND is connected to system ground, and terminal VCC is connected to power supply voltage $V_{cc}$; terminal REG is simply not connected, as the reference voltage from reference generator 24 is not used in the charge pump configuration.

In this operating mode, configuration register 95 is written with the appropriate bits or data word to cause switches 83A, 83B to connect the gates of respective transistors 82A, 82B to drive control circuit 88 in output driver 80. Switching regulator control circuit 86 is disabled in this mode. Charge pump control circuit 84 includes the appropriate conventional circuitry for controlling the operation of voltage regulator 128 as a charge pump voltage regulator. In this example, charge pump control circuit 84 includes a comparator for comparing the output voltage at terminal SENS against a bandgap reference voltage from bandgap reference circuit 24, and for generating a control signal to drive control circuit 88 in output driver 80. Additionally, various level shift circuits are typically enabled in this example, so that the gate drive of the transistor pairs 81, 82 is at the proper level.

Additional detail regarding the construction and operation of charge pump control circuit 84 is provided in the above-incorporated copending application Ser. No. 10/647,931, entitled "A Reconfigurable Topology for Switching and Charge Pump Negative Polarity Voltage Regulators".

In operation, charge pump control circuit 84 issues a pulse width modulated signal to drive control circuit 88, which in turn applies the appropriate signals to the gates of transistors 81A, 81B, 82A, 82B. In charge pump fashion, transistor pairs 81, 82 cooperate to first charge flyback capacitor 94 to a positive voltage relative to ground by turning on transistors 81A, 82A and then, by turning on transistors 81B, 82B, applying this voltage as a negative voltage (below ground) to terminal SENS, considering that the voltage across capacitor 94 cannot instantaneously change. This negative voltage charges capacitor 96, and the process is repeated at the desired pulse width modulation rate, until the desired negative voltage at terminal SENS and thus at output terminal $V_{out}$ is attained, at which point the modulation of transistors 81, 82 is adjusted accordingly.

According to the preferred embodiment of the invention, other features are also included within charge pump control circuit 84, including a negative fault indication function to indicate when voltage regulator 128 has not yet reached regulation, and circuitry responsive to configuration register 95 to select the desired regulated output voltage.

According to this embodiment of the invention, a configurable voltage regulator is provided, by way of which the voltage regulator can operate either as switching regulator or as a charge pump. In this embodiment of the invention, large output driver devices (e.g., transistors 81A, 81B) are used in both the charge pump and switching regulator modes, enabling the implementation of both topologies of voltage regulator circuits in a configurable fashion within the same integrated circuit. In addition, this permits the integration of these output driver devices within the integrated circuit itself, reducing the number of external components required, especially for the charge pump topology in which only the external flyback and output capacitors are required. This particular configuration is also especially useful in generating a regulated negative polarity voltage, and as such this configuration may be included in the same integrated circuit as the configurable positive polarity voltage regulator described above, if desired.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. An integrated circuit, comprising:

a plurality of terminals including at least one output terminal and at least one input terminal; and a configurable voltage regulator operable in a first mode or a second mode, comprising:

output driver circuitry, having an output terminal and an output coupled to said output terminal;

control circuitry, having an input terminal and at least one input coupled to said input terminal, having an output coupled to the output driver circuitry, and including a plurality of elements;

configuration circuitry, for receiving a configuration signal; and at least one configuration switch, for selectably coupling elements of a feedback circuitry to the output driver circuitry responsive to control signals from the configuration circuitry, wherein the control circuitry comprises:

an error amplifier having a first input coupled to a first input terminal, having a second input receiving a reference voltage, and having an output;

switching regulator control circuitry, having a first input and having an output;

wherein the at least one configuration switch comprises:

a first configuration switch for connecting the output of the error amplifier to the switching regulator control circuitry in a first position;

a second configuration switch, for connecting the output of the switching regulator control circuitry in a first position;

wherein the first and second configuration switches connect the output of the error amplifier to the output driver circuitry when in a second position;

and wherein the first and second configuration switches switch to the first and second positions responsive to a signal from the configuration circuitry.

2. The integrated circuit of claim 1, wherein the configuration circuitry comprises:

a configuration amplifier, having a first input connected to a second input terminal, and having a second input connected to a fixed voltage, the configuration amplifier having an output coupled to control inputs of the first and second configuration switches so that the first and second configuration switches are in the first and second positions responsive to the output of the configuration amplifier.

3. The integrated circuit of claim 1, wherein the switching regulator control circuitry comprises:

a current limit detect amplifier, having a first input connected to the second input terminal, having a second input coupled to a third input terminal, and having an output;

a switching control amplifier, having a first input connected to the first configuration switch, having a second input connected to the second input terminal, and having an output; and logic circuitry, having inputs coupled to the outputs of the current limit detect amplifier and the switching control amplifier, and having an output coupled to the second configuration switch.

4. The integrated circuit of claim 3, further comprising:

a voltage source coupled between the third input terminal and the second input of the current limit detect amplifier, for shifting the voltage at the third input terminal by a selected limit voltage.

5. The integrated circuit of claim 3, further comprising:

a one-shot multivibrator, having an input coupled to the output of the switching regulator control circuitry, and having an output coupled to the second configuration switch, for issuing a pulse responsive to a signal from the switching regulator control circuitry.

6. The integrated circuit of claim 5, wherein the one-shot multivibrator is a constant off-time one-shot multivibrator.

7. A method of generating a regulated voltage, comprising the steps of:

configuring a configurable voltage regulator in an integrated circuit into either a linear regulator mode or a switching regulator mode, the configurable voltage regulator comprising output drive circuitry having an output at a drive terminal, and comprising an error amplifier having an input coupled to a sense terminal;

connecting the gate of a transistor to the drive terminal;

in the switching regulator mode:

connecting an external network including an inductor to the transistor, the external network producing the regulated voltage;

connecting the error amplifier of the voltage regulator to the external network, so that the error amplifier receives a voltage corresponding to the regulated voltage;

in the linear regulator mode:

connecting an external network to the transistor, the external network producing the regulated voltage; and connecting the error amplifier of the voltage regulator to the external network, so that the error amplifier receives a voltage corresponding to the regulated voltage;

responsive to the configuring step configuring the configurable voltage regulator in the linear regulator mode, coupling the output of the error amplifier to the output drive circuitry; and responsive to the configuring step configuring the configurable voltage regulator in the switching regulator mode:

coupling the output of the error amplifier to switching regulator control circuitry; and coupling the output of the switching regulator control circuitry to the output drive circuitry, wherein the configuring step comprises:

comparing the voltage at a first sense terminal to a fixed voltage;

responsive to the comparing step determining that the voltage at the first sense terminal is in a first relationship relative to the fixed voltage, controlling configuration switches to couple the output of the error amplifier to the output drive circuitry to configure the voltage regulator in the linear regulator mode; and responsive to the comparing step determining that the voltage at the first sense terminal is in a second relationship relative to the fixed voltage, controlling the configuration switches to couple the output of the error amplifier to the switching regulator control circuitry, and to couple the switching regulator control circuitry to the output drive circuitry to configure the voltage regulator in the switching regulator mode.

8. The method of claim 7, wherein the configuring step further comprises:

biasing the first sense terminal to a voltage in the first relationship to the fixed voltage.

9. The method of claim 7, wherein the configuring step further comprises:

connecting the first sense terminal to the external network including the inductor so that the second terminal is in the second relationship to the fixed voltage.

10. A method of generating a regulated voltage, comprising the steps of:

configuring a configurable voltage regulator in an integrated circuit into either a linear regulator mode or a switching regulator mode, the configurable voltage regulator comprising output drive circuitry having an output at a drive terminal, and comprising an error amplifier having an input coupled to a sense terminal;

connecting the gate of a transistor to the drive terminal;

in the switching regulator mode:

connecting an external network including an inductor to the transistor, the external network producing the regulated voltage;

connecting the error amplifier of the voltage regulator to the external network, so that the error amplifier receives a voltage corresponding to the regulated voltage;

in the linear regulator mode:

connecting an external network to the transistor, the external network producing the regulated voltage; and connecting the error amplifier of the voltage regulator to the external network, so that the error amplifier receives a voltage corresponding to the regulated voltage;

responsive to the configuring step configuring the configurable voltage regulator in the linear regulator mode, coupling the output of the error amplifier to the output drive circuitry; and responsive to the configuring step configuring the configurable voltage regulator in the switching regulator mode:

coupling the output of the error amplifier to switching regulator control circuitry; and coupling the output of the switching regulator control circuitry to the output drive circuitry, further comprising, in the switching regulator mode:

generating a pulse with a constant off-time from the switching regulator control circuitry responsive to an output of the error amplifier.

11. The method of claim 10, further comprising, in the switching regulator mode:

connecting second and third sense terminals of the voltage regulator across a resistor in series with the inductor;

comparing a voltage across the second and third sense terminals with a limit voltage; and responsive to the compared voltage exceeding the limit voltage, disabling the generating step.

12. A method of generating a regulated voltage, comprising the steps of:

configuring a configurable voltage regulator in an integrated circuit into either a linear regulator mode or a switching regulator mode, the configurable voltage regulator comprising output drive circuitry having an output at a drive terminal, and comprising an error amplifier having an input coupled to a sense terminal;

connecting the gate of a transistor to the drive terminal;

in the switching regulator mode:

connecting an external network including an inductor to the transistor, the external network producing the regulated voltage;

connecting the error amplifier of the voltage regulator to the external network, so that the error amplifier receives a voltage corresponding to the regulated voltage;

in the linear regulator mode:

connecting an external network to the transistor, the external network producing the regulated voltage; and connecting the error amplifier of the voltage regulator to the external network, so that the error amplifier receives a voltage corresponding to the regulated voltage;

responsive to the configuring step configuring the configurable voltage regulator in the linear regulator mode, coupling the output of the error amplifier to the output drive circuitry; and responsive to the configuring step configuring the configurable voltage regulator in the switching regulator mode:

coupling the output of the error amplifier to switching regulator control circuitry; and coupling the output of the switching regulator control circuitry to the output drive circuitry, wherein the configuring step comprises:

writing configuration data into a configuration register.

* * * * *

UNITED STATES PATENT AND TRADEMARK OFFICE

CERTIFICATE OF CORRECTION

PATENT NO. : 7,602,167 B2
APPLICATION NO. : 10/646854
DATED : October 13, 2009
INVENTOR(S) : Trafton et al.

It is certified that error appears in the above-identified patent and that said Letters Patent is hereby corrected as shown below:

The exact page and line number where the error is visible in the application filed is found on page 1, column 1, item [75]. The inventor's first name is incorrectly spelled. Please correct to read -- Fredrick Trafton --.

Signed and Sealed this

Twentieth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,602,167 B2
APPLICATION NO. : 10/646854
DATED : October 13, 2009
INVENTOR(S) : Trafton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 820 days.

Signed and Sealed this

Fifth Day of October, 2010

David J. Kappos

David J. Kappos
*Director of the United States Patent and Trademark Office*